US010234105B2

(12) United States Patent
Jurik

(10) Patent No.: US 10,234,105 B2
(45) Date of Patent: Mar. 19, 2019

(54) OPTICS FOR AN AUTOMATED LUMINAIRE

(71) Applicant: Robe Lighting s.r.o., Roznov pod Radhostem (CZ)

(72) Inventor: Pavel Jurik, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 14/459,271

(22) Filed: Aug. 13, 2014

(65) Prior Publication Data

US 2016/0047533 A1 Feb. 18, 2016
US 2018/0163950 A9 Jun. 14, 2018

Related U.S. Application Data

(63) Continuation of application No. 12/880,076, filed on Sep. 11, 2010, now abandoned.

(60) Provisional application No. 61/241,882, filed on Sep. 12, 2009.

(51) Int. Cl.
*F21V 14/06* (2006.01)
*F21V 5/04* (2006.01)
*F21W 131/406* (2006.01)

(52) U.S. Cl.
CPC ..... *F21V 14/06* (2013.01); *F21V 5/045* (2013.01); *F21W 2131/406* (2013.01)

(58) Field of Classification Search
CPC .... F21V 14/06; F21V 5/045; F21W 2131/406
USPC ..... 362/332, 285
See application file for complete search history.

(56) References Cited

U.S. PATENT DOCUMENTS 4,827,387 A 5/1989 Ferren et al.
5,544,029 A 8/1996 Cunningham
6,062,710 A * 5/2000 Hewitt ..... F21S 48/1225 359/19
6,113,252 A 9/2000 Arlitt et al.
6,412,972 B1 * 7/2002 Pujol ..... G09F 19/18 348/E5.142
6,807,369 B1 10/2004 Tenmyo
7,192,165 B2 3/2007 Petzl et al.
7,226,190 B2 6/2007 Petzl et al.
7,543,955 B2 * 6/2009 Belliveau ..... F21S 10/007 362/11
2004/0017685 A1 1/2004 Dedoro
2004/0042212 A1 * 3/2004 Du ..... F21S 8/02 362/296.04
2006/0126336 A1 * 6/2006 Solomon ..... F21S 10/007 362/277
2007/0070062 A1 3/2007 Boll
(Continued)

FOREIGN PATENT DOCUMENTS

CN 2577526 Y 10/2003
EP 1384941 A2 1/2004

OTHER PUBLICATIONS

Office Action dated Mar. 14, 2012; U.S. Appl. No. 12/880,076, filed Sep. 11, 2010; 6 pages.

(Continued)

*Primary Examiner* — Anh T Mai
*Assistant Examiner* — Glenn D Zimmerman
(74) *Attorney, Agent, or Firm* — Conley Rose, P.C.; Grant Rodolph; Brooks W Taylor

(57) ABSTRACT

A gimbaled remotely automated pan and tilt luminaire with a multi-gobo rotating-gobo imager between a focusing light source and a highly faceted Fresnel output lens with sharp pointed facets which is articulated to move along the light path closer to or further away from the light source and gobo imager.

4 Claims, 6 Drawing Sheets

(56) References Cited

U.S. PATENT DOCUMENTS

| | | | | |
|---|---|---|---|---|
| 2007/0297065 | A1* | 12/2007 | Valter | G02B 5/045 359/641 |
| 2008/0062681 | A1 | 3/2008 | Belliveau et al. | |
| 2008/0062683 | A1* | 3/2008 | Belliveau | F21S 10/007 362/231 |
| 2009/0109680 | A1* | 4/2009 | Belliveau | F21S 10/007 362/277 |
| 2011/0103063 | A1* | 5/2011 | Jurik | F21V 5/045 362/285 |
| 2012/0120647 | A1* | 5/2012 | Li | F21V 5/007 362/230 |

OTHER PUBLICATIONS

Final Office Action dated Nov. 7, 2012; U.S. Appl. No. 12/880,076, filed Sep. 11, 2010; 9 pages.

Office Action dated Jun. 28, 2013; U.S. Appl. No. 12/880,076, filed Sep. 11, 2010; 7 pages.

Final Office Action dated Feb. 13, 2014; U.S. Appl. No. 12/880,076, filed Sep. 11, 2010; 9 pages.

PCT International Search Report; Application No. PCT/US2010/048548; dated Jan. 27, 2011; 3 pages.

PCT Written Opinion of the International Searching Authority; Application No. PCT/US2010/048548; dated Jan. 27, 2011; 3 pages.

Chinese Office Action; Application No. 201080050699.2; dated Feb. 21, 2014; 9 pages.

Chinese Office Action; Application No. 201080050699.2; dated Dec. 9, 2014; 11 pages.

Chinese Office Action; Application No. 201080050699.2; dated Nov. 24, 2015; 10 pages.

Chinese Office Action; Application No. 201080050699.2; dated May 5, 2016; 7 pages.

* cited by examiner

OPTICS FOR AN AUTOMATED LUMINAIRE

CROSS-REFERENCE TO RELATED APPLICATIONS

This application is a continuation of U.S. patent application Ser. No. 12/880,076, entitled "IMPROVED OPTICS FOR AN AUTOMATED LUMINAIRE", filed on Sep. 11, 2010, which claims the benefit of U.S. Provisional Application No. 61/241,882, entitled "IMPROVED OPTICS FOR AN AUTOMATED LUMINAIRE", filed on Sep. 12, 2009.

TECHNICAL FIELD OF THE DISCLOSURE

The present disclosure generally relates to an automated luminaire, specifically to an optical system for use within an automated luminaire.

BACKGROUND OF THE DISCLOSURE

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern. The beam pattern is often provided by a stencil or slide called a gobo which may be a steel, aluminum, or etched glass pattern.

FIG. 1 illustrates a typical multiparameter automated luminaire system 10. These systems commonly include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each automated luminaire 12 is connected in series or in parallel via data link 14 to one or more control desks 15. The automated luminaire system 10 is typically controlled by an operator through the control desk 15.

FIG. 2 illustrates a prior art automated luminaire 12. A lamp 21 contains a light source 22 which emits light. The light is reflected and controlled by reflector 20 through optical devices 26, which may include dichroic color filters, effects glass, and other optical devices well known in the art, and then through an aperture or imaging gate 24. Optical components 27 are imaging components and may include gobos, rotating gobos, an iris, and framing shutters. The final output beam may be transmitted through output lens 31. Output lens 31 may be a short focal length glass lens or equivalent Fresnel lens as described herein. Either optical components 27 or output lens 31 may be moved backwards and forwards along the optical axis (as shown by arrows 27*a* and 31*a*, respectively) to provide focus adjustment for the imaging components.

There is a need for an improved lens system for an automated luminaire which provides easy and rapid focus adjustment without compromising the automated movement of the automated luminaire.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE DISCLOSURE

Preferred embodiments of the present disclosure are illustrated in the FIGUREs, like numerals being used to refer to like and corresponding parts of the various drawings.

The present disclosure generally relates to an automated luminaire, specifically to the configuration of an output lens within such a luminaire such that the lens provides sharply focused images and is movable to provide focus adjustment while being light weight so that it may be moved easily and rapidly and any changes to the center of gravity of the automated luminaire are minimized.

Figure 1:
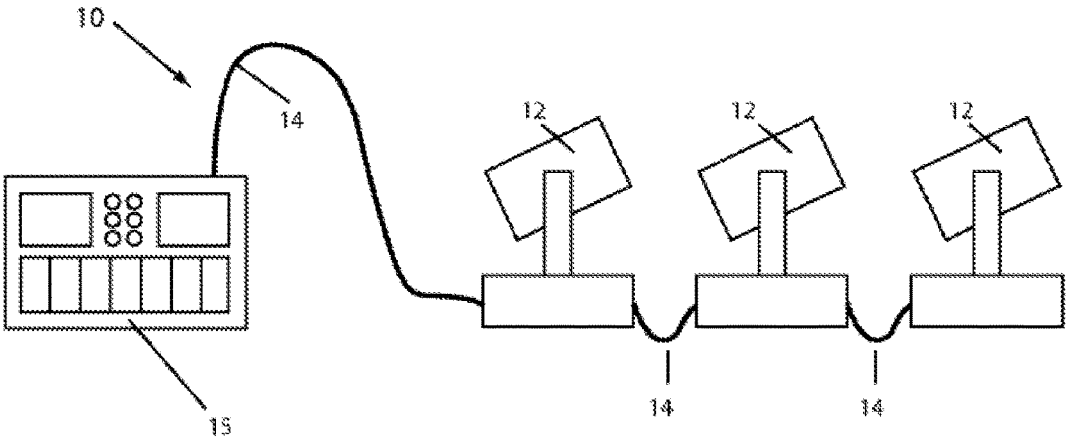
FIG 1 (PRIOR ART)
FIG. 1 illustrates a typical multiparameter automated luminaire system.
Figure 2:
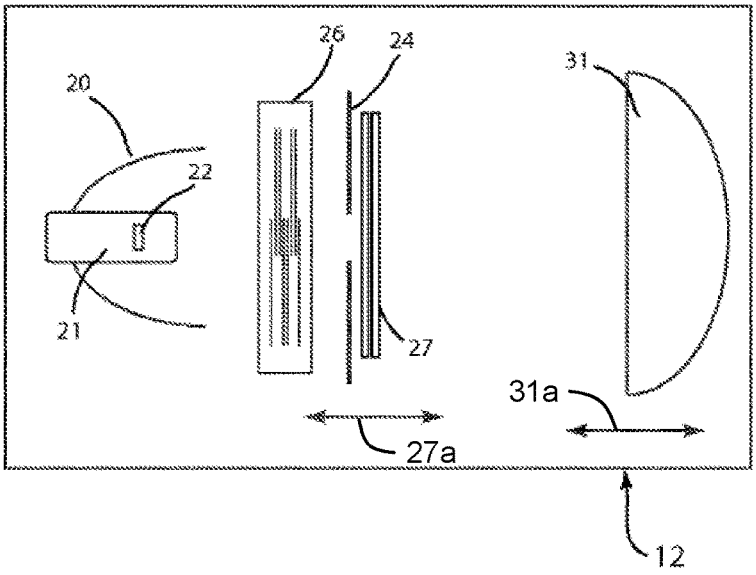
FIG 2 (PRIOR ART)
FIG. 2 illustrates a prior art automated luminaire.
Figure 3:
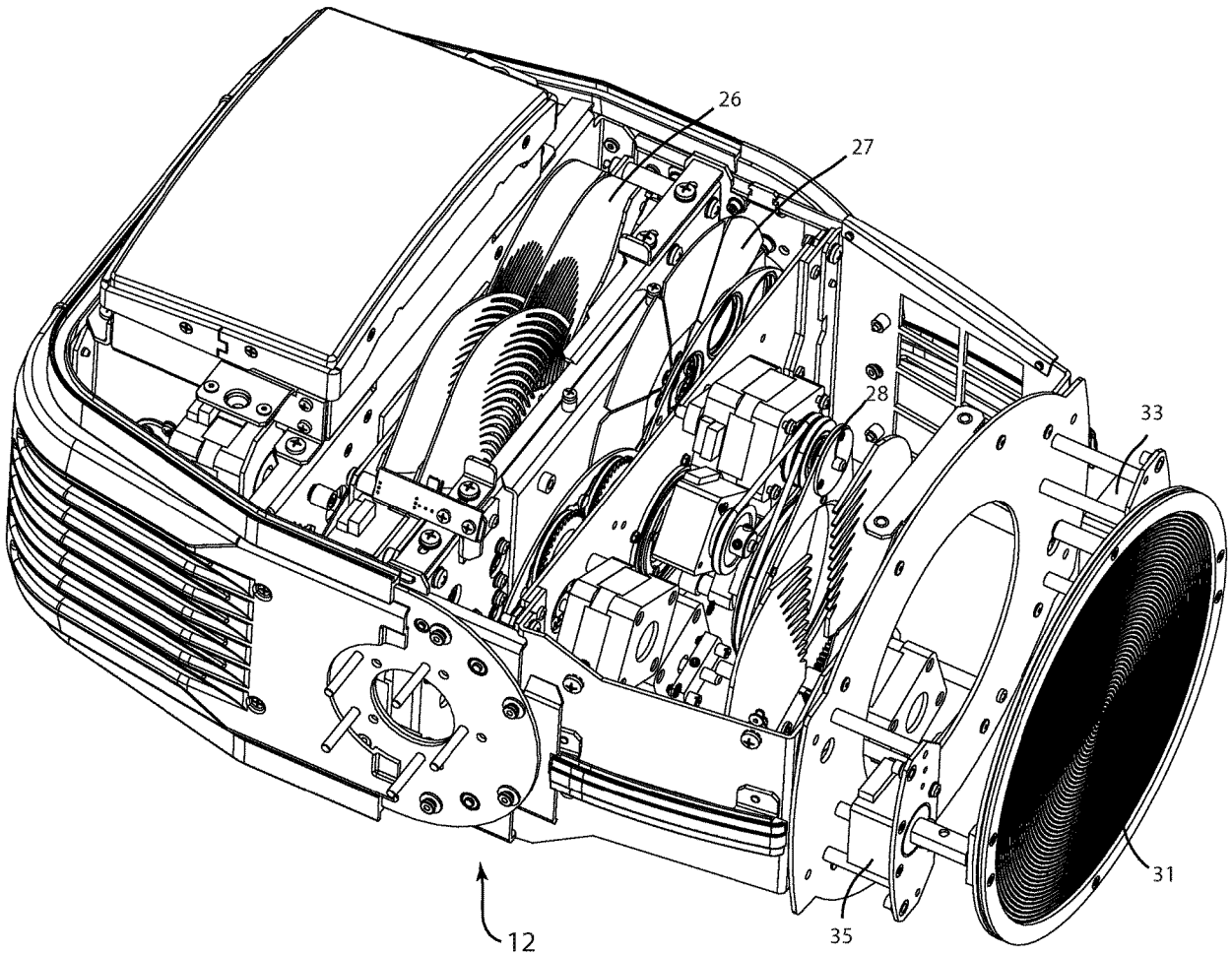
FIG. 3 illustrates an automated luminaire with an improved optical focus system.
Figure 7:
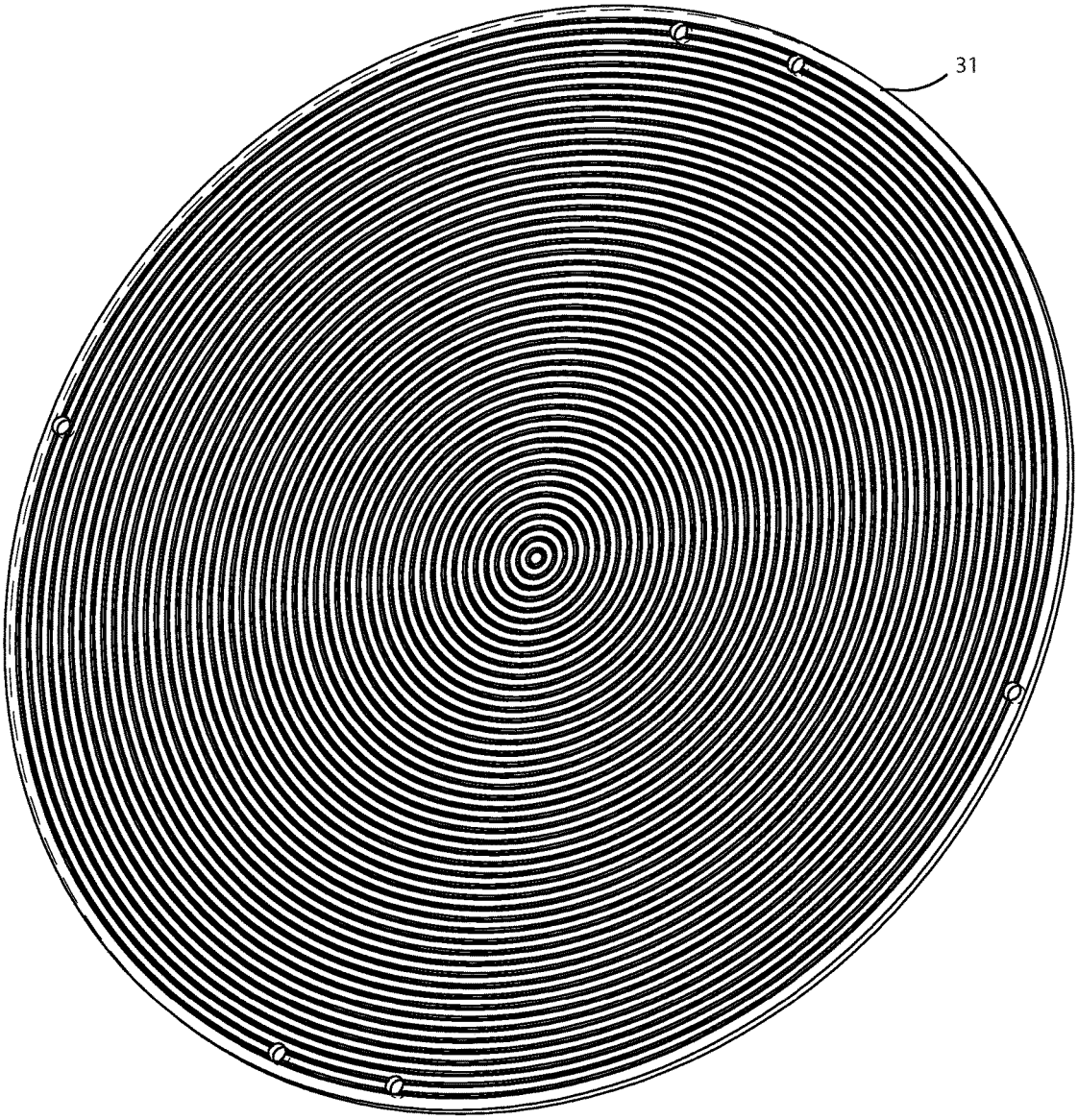
FIG. 7 illustrates a perspective view of the Fresnel lens.
Figure 8:
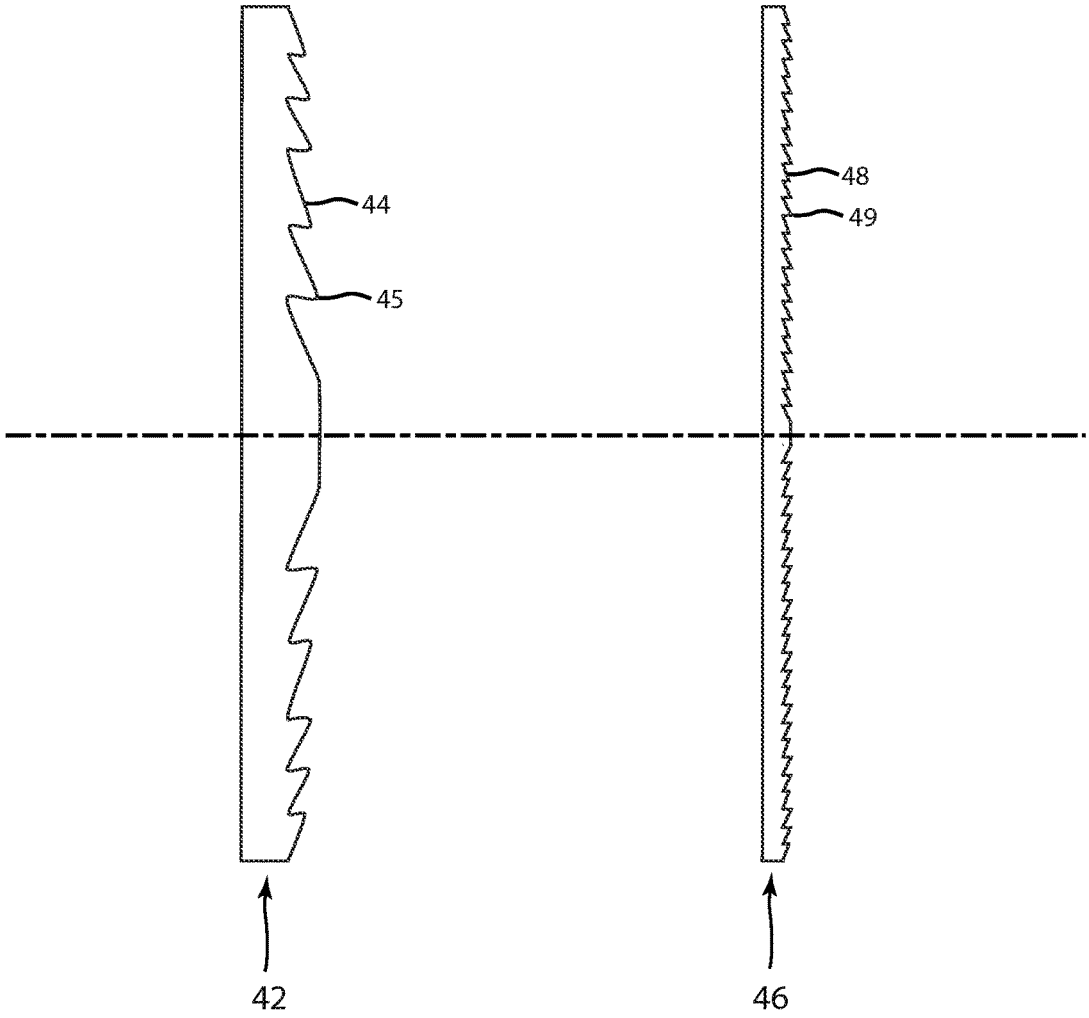
FIG. 8 illustrates a typical prior art Fresnel lens and an improved Fresnel lens.

FIG. 3 illustrates an automated luminaire 12 with an improved optical focus system according to the disclosure. Automated luminaire 12 contains imaging optical components 27 and 28 which may include but are not limited to gobos, rotating gobos, shutters, and irises. The light beam from these images is focused by output lens 31. In the illustrated embodiment, the output lens 31 incorporates an improved Fresnel lens. Output lens 31 may be a Fresnel lens as shown in FIG. 7 and FIGS. 8 (31 and 46 respectively) Where a typical prior art Fresnel lens (42 in FIG. 8) typically comprises 10-15 circumferential facets for a 150 mm (millimeter) diameter lens, the Fresnel output lens 31 in the embodiment illustrated in FIG. 3 has at least twice, or more, the number of circumferential facets. This substantial increase in the number of circumferential facets serves to significantly improve the optical resolution of the lens and thus provide a sharper output image. In one embodiment, the Fresnel output lens 31 has approximately 100 circumferential facets.

Further improvement is provided by the shape of the facets. A typical prior art Fresnel lens 42 is manufactured of glass and suffers from surface tension effects during molding such that the tips 45 of each facet 44 are rounded to a large radius. This radius causes scattering of the transmitted light and thus softens the projected image. In the embodiment illustrated in FIG. 3, the Fresnel output lens 31 is manufactured of a plastic or polymer through a molding process that provides significantly reduced radius of curvature on the pointed tips 49 of the facet 48. This smaller radius of curvature significantly reduces light scattering from the tips 49 and thus provides enhanced sharpness in the projected image.

The choice of material as a polymer or plastic further serves to reduce the weight of output lens 31. Output lens 31 may be moved backwards and forwards along the optical axis of the luminaire 12 so as to provide focus adjustment of the projected images of desired optical components 27. In one embodiment of the disclosure motors 33 and 35 may provide the movement of output lens 31 through lead screw drives 34 and 36. Motors 33 and 35 may be low power stepper motors.

Figure 4:
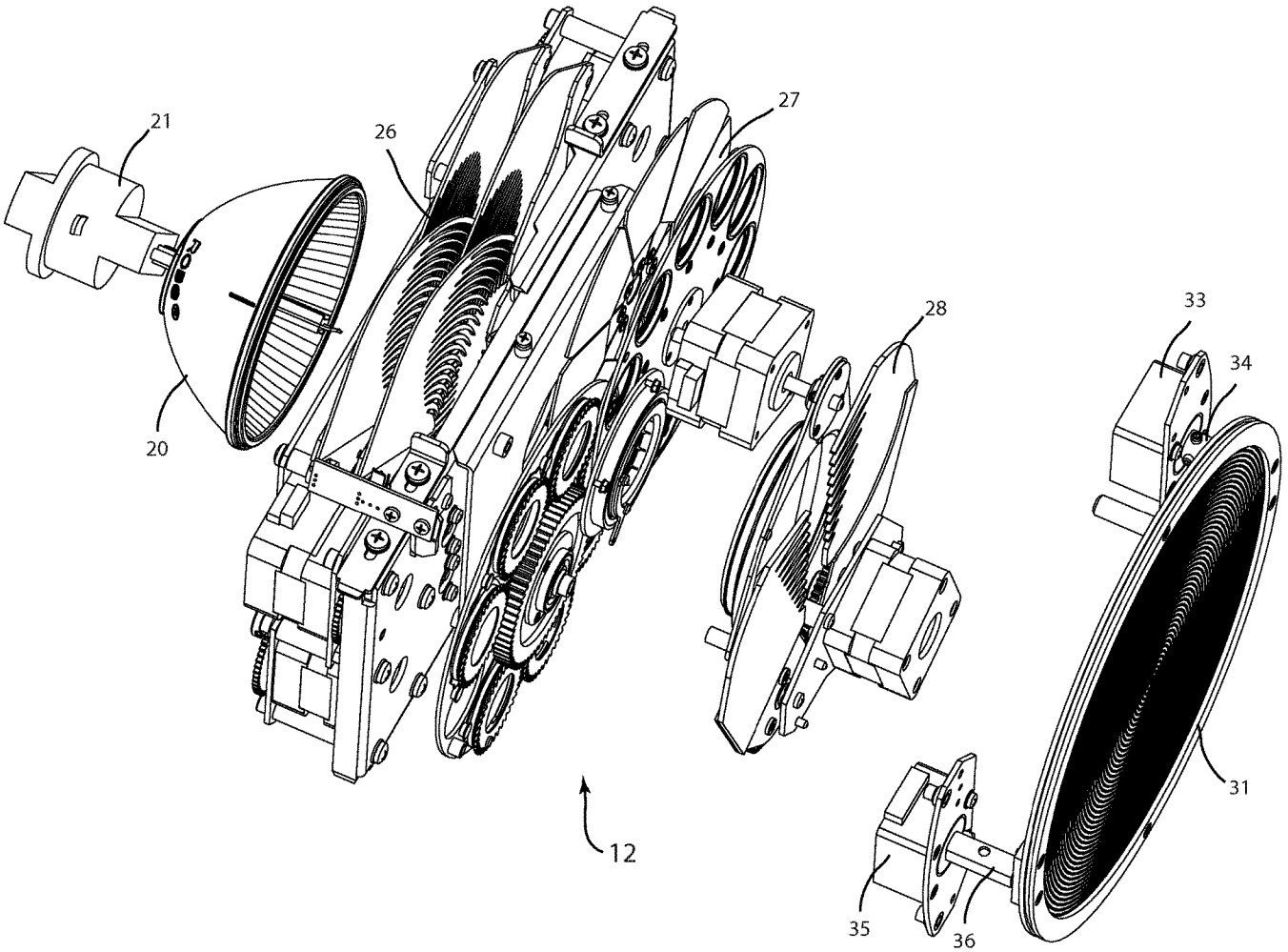
FIG. 4 illustrates an exploded view of some of the components of the embodiment illustrated in FIG. 3.

FIG. 4 illustrates an exploded view of some of the components of the embodiment illustrated in FIG. 3. Motors 33 and 35 provide movement of output lens 31 along the optical axis through lead screw drives 34 and 36. Movement of output lens 31 serves to provide focus adjustment of the projected images of desired optical components 27.

In one embodiment of the disclosure motors 33 and 35 may provide the movement of output lens 31 through lead screw drives 34 and 36. Motors 33 and 35 may be relatively low power stepper motors.

Figure 5:
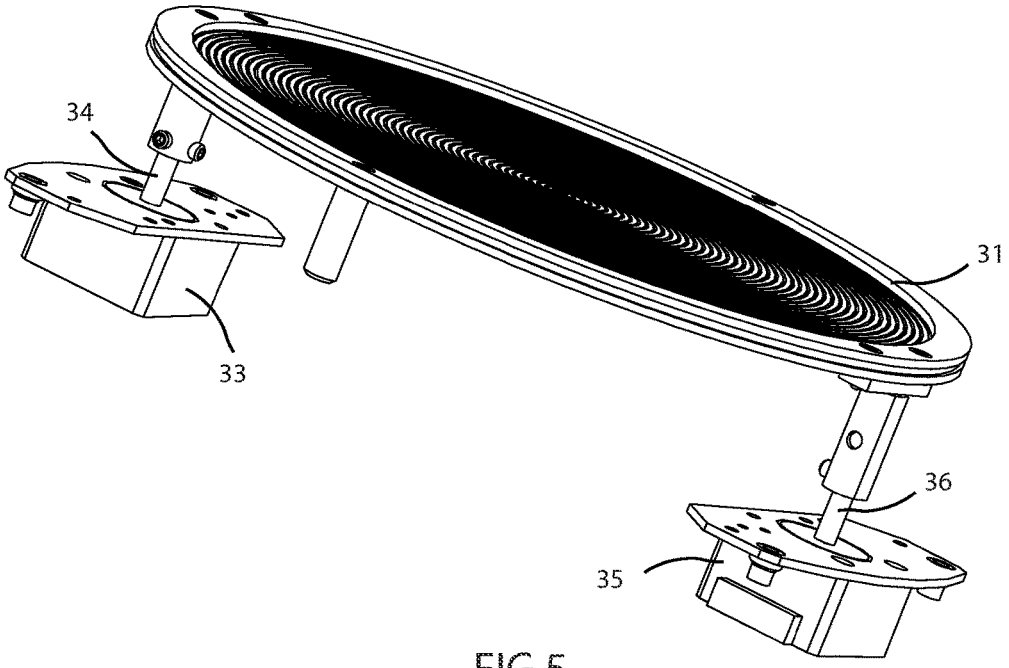
FIG. 5 illustrates a first position of the Fresnel lens of the improved optical focus system of FIG. 3.
Figure 6:
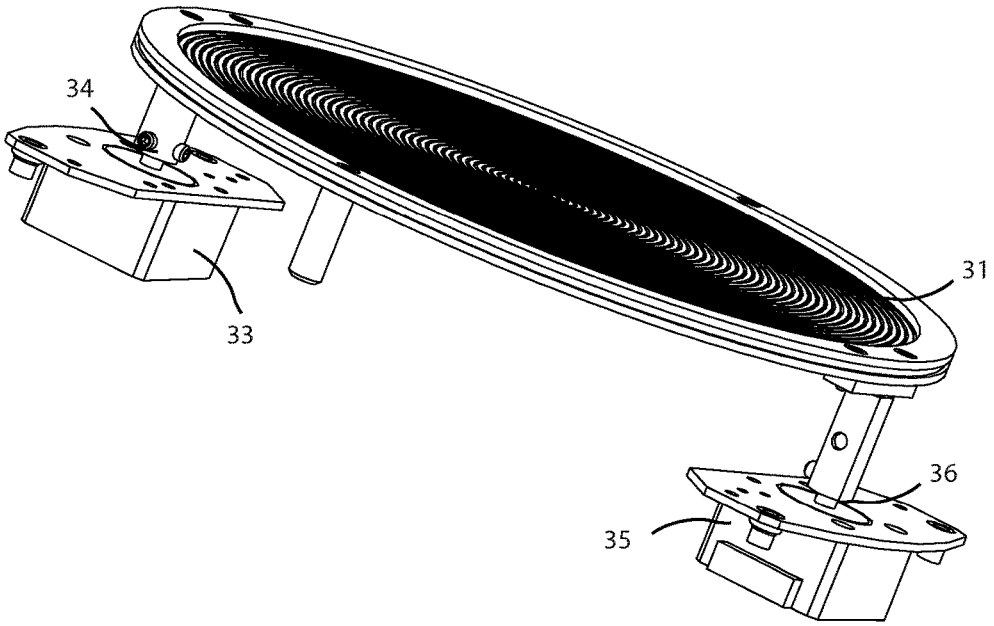
FIG. 6 illustrates a second position of the Fresnel lens of FIG. 5.

FIG. 5 and FIG. 6 illustrate the movement of output lens 31 along the optical axis of the luminaire. In one embodiment of the disclosure, output lens 31 is positioned by lead screws 34 and 36 connected to motors 33 and 35. Rotation of motors 33 and 35 causes rotation of lead screws 34 and 36 and thus movement of output lens 31. FIG. 5 shows Fresnel output lens 31 in a first position and FIG. 6 shows Fresnel lens 31 in a second position. Although lead screws 34 and 36 are illustrated as the means for translating rotary motion of motors 33 and 35 into the linear motion of output lens 31, the disclosure is not so limited and output lens 31 may be moved along the optical axis using belt drives, rack and pinion drive, linear actuators, or any other method of driven linear motion known in the art. Output lens 31 is a thin, lightweight polymer Fresnel lens such that motors 33 and 35 may be relatively small, low powered motors of type selected from but not limited to stepper motors, servo motors, linear actuators, or low powered DC (direct current) motors.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

I claim:

1. An imaging automated luminaire comprising:

an elliptical reflector having a first focal point internal to the elliptical reflector and a second focal point external to the elliptical reflector;

a light source located at the first focal point, the light source and the elliptical reflector configured to generate a light beam having an optical axis;

an imaging gate positioned at the second focal point;

an imager mounted adjacent to the imaging gate, the imager configured to convert the light beam into an imaged light beam directed to a Fresnel output lens without passing through intervening lenses; and a pan and tilt movement gimbaled housing for the elliptical reflector, light source, imaging gate, imager and Fresnel output lens, wherein the Fresnel output lens comprises a polymer lens, and wherein the Fresnel output lens is articulable along the optical axis to adjust a focus of the imaged light beam.

2. The luminaire of claim 1 wherein the imager is a gobo mounted in a gobo wheel carrying a plurality of gobos, wherein the gobo wheel is articulated to position individual gobos into the optical axis adjacent to the imaging gate.

3. The luminaire of claim 2 wherein the individual gobos are articulated to rotate.

4. An imaging automated luminaire comprising:

a housing articulated to change a pan and tilt orientation of a light beam emitted by the luminaire;

an elliptical reflector mounted in the housing and having a first focal point internal to the elliptical reflector and a second focal point external to the elliptical reflector;

a light source located at the first focal point, the light source and the elliptical reflector configured to generate a light beam having an optical axis;

an imager mounted adjacent to an imaging gate positioned at the second focal point, the imager configured to convert the light beam into an imaged light beam; and a polymer Fresnel output lens articulable along the optical axis and configured to receive the imaged light beam from the imager without passing through intervening lenses.

* * * * *